US010017196B1

(12) United States Patent
Hogan

(10) Patent No.: US 10,017,196 B1
(45) Date of Patent: Jul. 10, 2018

(54) WIRELESS CROSSING WARNING ACTIVATION AND MONITORING

(71) Applicant: Siemens Industry, Inc., Alpharetta, GA (US)

(72) Inventor: Brian Joseph Hogan, Temecula, CA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/611,054

(22) Filed: Jun. 1, 2017

(51) Int. Cl.

| | |
|---|---|
| ***G08G 1/07*** | (2006.01) |
| ***G08G 1/08*** | (2006.01) |
| ***B61L 29/18*** | (2006.01) |
| ***B61L 29/16*** | (2006.01) |
| ***B61L 29/28*** | (2006.01) |
| ***G08G 1/16*** | (2006.01) |
| ***B61L 29/24*** | (2006.01) |

(52) U.S. Cl.
CPC ..... *B61L 29/18* (2013.01); *B61L 29/16* (2013.01); *B61L 29/246* (2013.01); *B61L 29/28* (2013.01); *G08G 1/16* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,179,252 | B1 * | 1/2001 | Roop | B61L 29/18 246/122 R |
| 6,463,337 | B1 * | 10/2002 | Walker | B61L 1/20 246/167 D |
| 8,171,290 | B1 * | 5/2012 | Sikora | H04B 10/112 340/426.1 |
| 8,469,319 | B2 * | 6/2013 | Kiss, Jr. | B61L 29/284 246/125 |
| 9,026,283 | B2 * | 5/2015 | Baldwin | B61L 29/282 701/19 |
| 2005/0184883 | A1 * | 8/2005 | Graham | B61L 29/28 340/917 |
| 2011/0133038 | A1 * | 6/2011 | Kiss, Jr. | B61L 29/24 246/126 |
| 2013/0062474 | A1 * | 3/2013 | Baldwin | B61L 29/282 246/122 R |
| 2013/0193275 | A1 * | 8/2013 | Baines | B61L 29/00 246/111 |
| 2016/0257322 | A1 * | 9/2016 | Toshack | B61L 13/002 |
| 2017/0355388 | A1 * | 12/2017 | Schultz | B61L 29/32 |

* cited by examiner

*Primary Examiner* — Travis Hunnings

(57) ABSTRACT

A communication system may wirelessly receive. A crossing controller may check the message to determine whether the message is a valid vital communication. In response to determining the message is the valid vital communication, the crossing controller may deactivate at least one crossing traffic control element. While the at least one crossing traffic control element is deactivated, the crossing controller may activate the at least one crossing traffic control element in response to receiving a command to activate the at least one crossing traffic control element at the communication system. In response to determining the message is not the valid vital communication, the crossing controller may activate the at least one crossing traffic control element.

22 Claims, 5 Drawing Sheets

WIRELESS CROSSING WARNING ACTIVATION AND MONITORING

BACKGROUND

Railroad crossings, where vehicle and/or pedestrian paths cross railways, are accompanied by signaling and traffic control equipment. For example, a railroad crossing can include warning lights, warning alarms, gates, or combinations thereof. This equipment is configured to interface with activation and monitoring equipment (e.g., grade crossing predictors and/or event recorders) by wired connection. The wired connection provides a vital interface between equipment (i.e., an interface that is substantially fail-safe).

DETAILED DESCRIPTION OF SEVERAL EMBODIMENTS

Systems and methods described herein may reduce or eliminate cabling and enclosures at railroad crossings while still providing vitality. One or more crossing controllers may provide control signals for crossing signaling and traffic control equipment. For example, crossing controllers may provide the signals necessary to control crossing warning system elements such as lamps, bells, and gate motor circuits. Rather than being located in a wayside enclosure and being connected with crossing signaling and traffic control equipment by wire, crossing controllers may be located virtually anywhere and may communicate with other equipment wirelessly.

In some embodiments, railroad crossings may have two masts with lights, bells, and gates, one for each direction of crossing traffic. A crossing controller may be located on one or both of the masts, for example. A wireless vital communication link may be provided between each crossing controller on each mast to a remote crossing activation device (e.g. a grade crossing predictor) in a wayside side enclosure.

Figure 1:
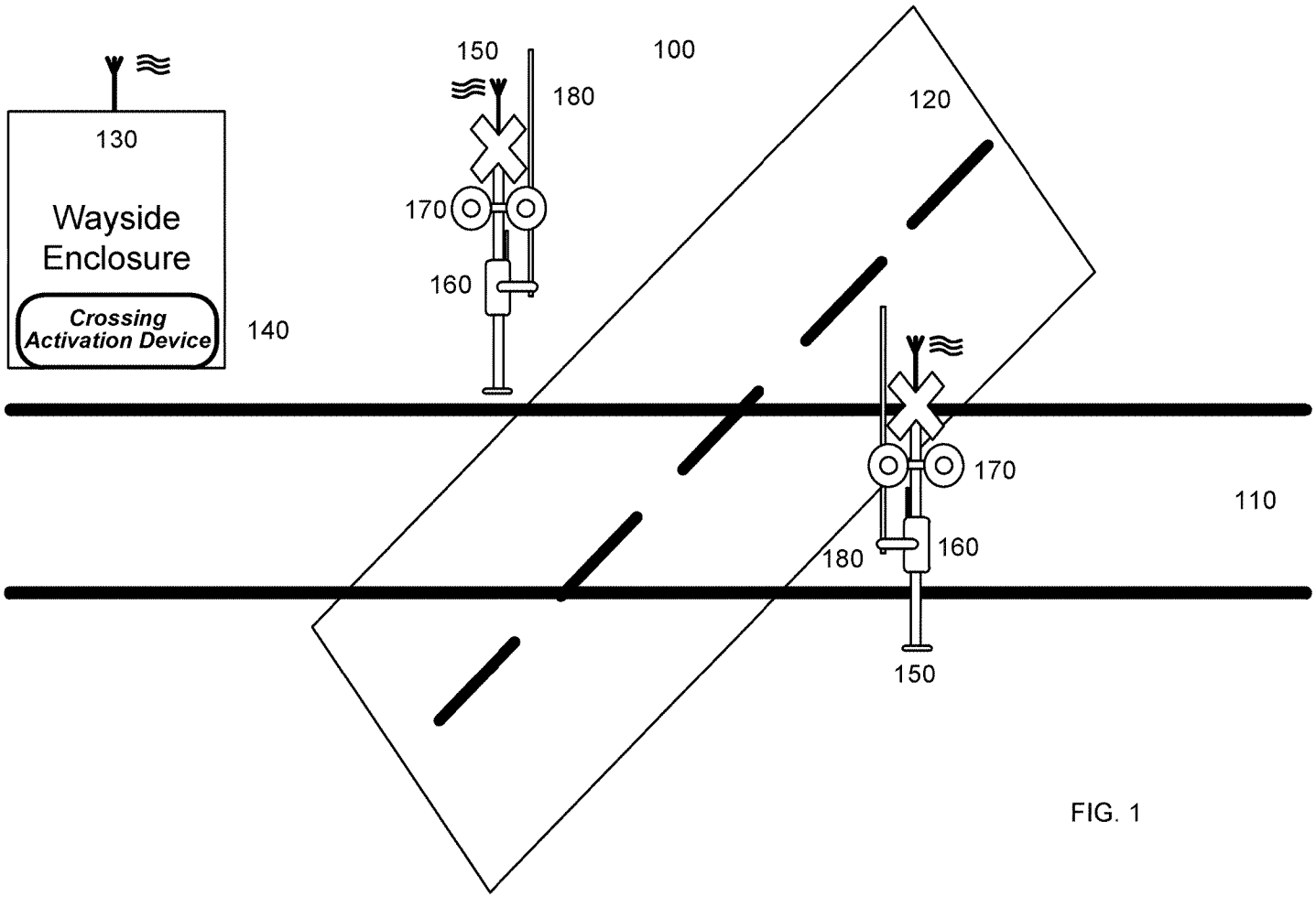
FIG. 1 shows a railroad crossing according to an embodiment of the invention.

FIG. 1 is a railroad crossing 100 according to an embodiment of the invention, where railroad track 110 and another path 120 (here, a road) cross. A wayside enclosure 130 may be installed at crossing 100. Wayside enclosure 130 may include power equipment and/or control electronics, including systems that may communicate with other railroad control elements located remotely from crossing 100. Wayside enclosure 130 may include a crossing activation device 140 configured to control crossing signaling and traffic control equipment. For example, when a train is approaching, crossing activation device 140 may direct lights to flash or illuminate, audio alarms to sound, and/or gates to close.

Crossing 100 may also include one or more masts 150. For example, one mast 150 may be disposed on each side of track 110 to direct traffic on each direction of road 120. Each mast 150 may include mast electronics 160, lights 170, a gate 180, and/or an audio alarm (not shown). Mast electronics 160 may communicate wirelessly with crossing activation device 140. Mast electronics 160 may be electrically coupled to lights 170, gate 180, and/or audio alarm and may control these elements (e.g., direct lights 170 to flash or illuminate, audio alarm to sound, and/or gate 180 to close) based on data received from crossing activation device 140.

Figure 2:
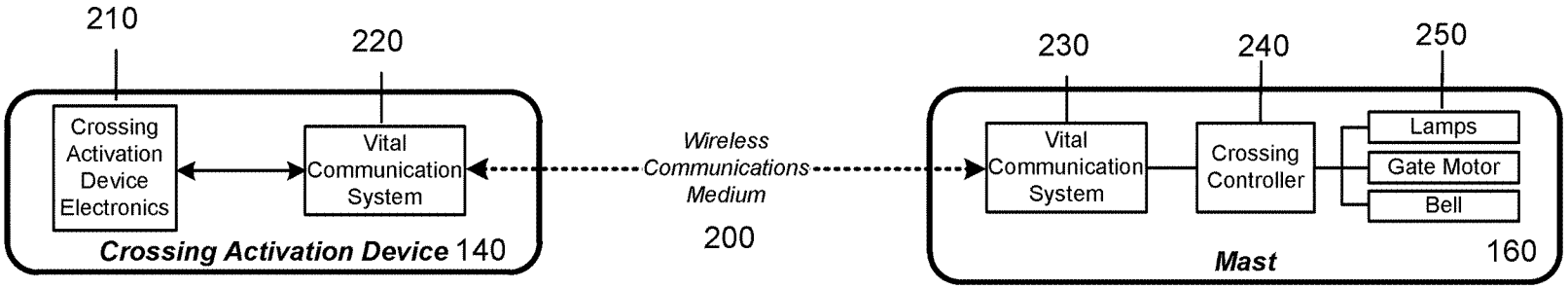
FIG. 2 shows a communication network according to an embodiment of the invention.

FIG. 2 is a communication network according to an embodiment of the invention. The network may include crossing activation device 140 and mast electronics 160. Crossing activation device 140 may include crossing activation device electronics 210 coupled to vital communication system 220. Mast electronics 160 may include a crossing controller 240 coupled to vital communication system 230 and crossing signaling and traffic control equipment 250 (e.g., lamps, gate motor, and bell). Vital communication systems 220, 230 may communicate with one another using wireless communication medium 200. For example, wireless communication medium 200 may be an electromagnetic (e.g., RF) medium.

Crossing activation device electronics 210 may determine that crossing signaling and traffic control equipment 250 should be activated (e.g., upon detection of a train on track 110, upon receiving a message from other railroad systems, etc.). Upon making this determination, crossing activation device electronics 210 may communicate a command to activate crossing signaling and traffic control equipment 250 to crossing controller 240. The command may be sent by crossing activation device vital communication system 220 and received by mast vital communication system 230. In addition to providing explicit commands to operate crossing signaling and traffic control equipment 250, crossing activation device vital communication system 220 may periodically send messages to mast vital communication system 230 to keep the connection between the two systems 220, 230 active.

Figure 3:
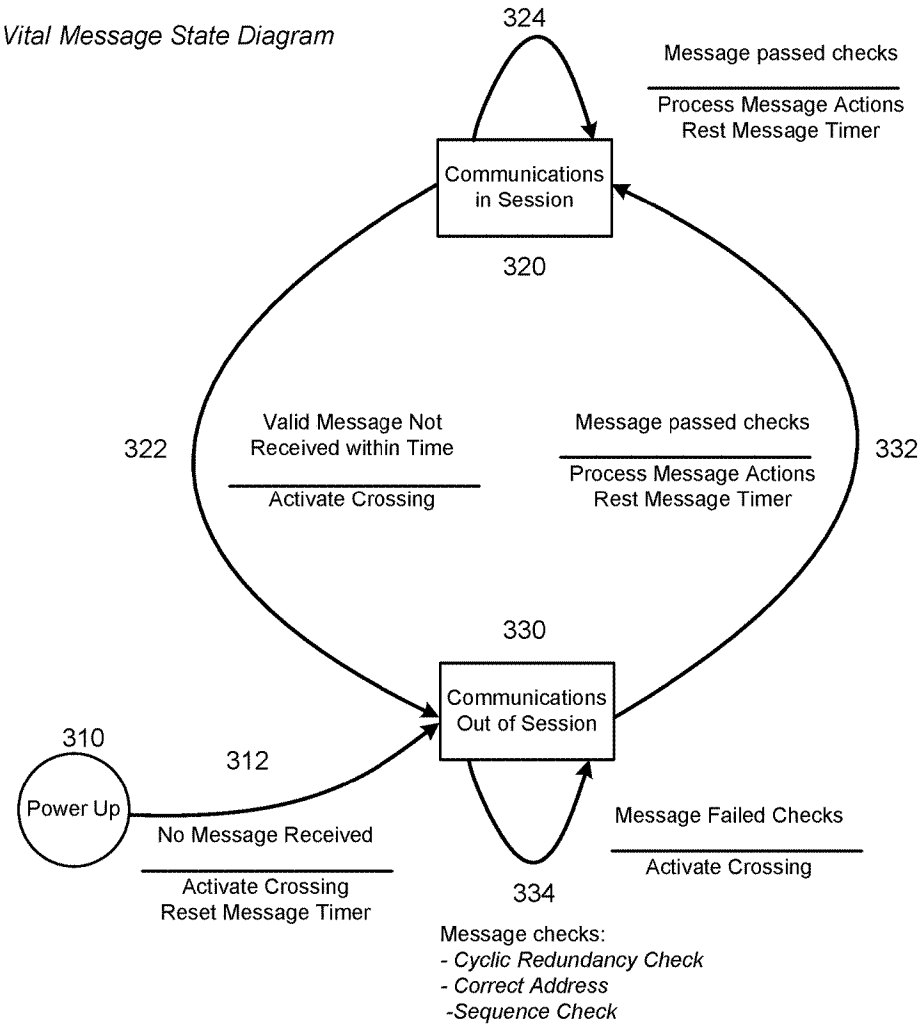
FIG. 3 is a vital message state diagram according to an embodiment of the invention.

The connection between crossing activation device vital communication system 220 and mast vital communication system 230 may be made vital through operation of mast vital communication system 230 and crossing controller 240. For example, FIG. 3 is a vital message state diagram according to an embodiment of the invention. Crossing controller 240 may ensure crossing safety in the event of failure by one or more elements of crossing activation device 140 through the implementation of the illustrated states. The state of crossing controller 240 may be dictated by whether mast vital communication system 230 is receiving communications from crossing activation device vital communication system 220 or not.

Crossing controller 240 may have a power up state 310. Crossing controller 240 may enter power up state 310 upon being initially powered on or reset. In power up state 310, crossing controller 240 may not yet be receiving any messages from crossing activation device vital communication system 220 through mast vital communication system 230.

Crossing controller 240 may have a communications in session state 320. Crossing controller 240 may be in communications in session state 320 after power up while receiving valid vital messages from crossing activation device vital communication system 220 through mast vital communication system 230. Crossing activation device vital communication system 220 may send vital communications periodically. Accordingly, crossing controller 240 may be in communications in session state 320 as long as crossing controller 240 has received a valid vital message from crossing activation device vital communication system 220 before the expiration of a crossing reset message timer that may be reset upon receipt of each valid vital message. When crossing controller 240 is in communications in session state 320, crossing controller 240 may deactivate crossing signaling and traffic control equipment 250 unless directed to activate crossing signaling and traffic control equipment 250 by crossing activation device electronics 210.

Crossing controller 240 may have a communications out of session state 330. Crossing controller 240 may enter communications out of session state 330 at any time after power up during which crossing controller 240 is not receiving valid vital messages from crossing activation device vital communication system 220 through mast vital communication system 230. While in communications out of session state 330, crossing controller 240 may activate crossing signaling and traffic control equipment 250 as a precautionary measure. For example, crossing controller 240 may default to a state where crossing signaling and traffic control equipment 250 are active to prevent encroachment onto track 110 in case a train is approaching or present, but crossing activation device electronics 210 is unable to communicate the train's presence to crossing controller 240.

In some embodiments, crossing controller 240 may transition between states as follows. Crossing controller 240 may transition 312 from power up state 310 to communications out of session state 330 and activate the crossing reset message timer after powering up.

Once powered up, crossing controller 240 may listen for messages on mast vital communication system 230. If no message is received, or if a message is received and does not pass a check procedure (e.g., as discussed below), crossing controller 240 may remain 334 in communications out of session state 330. While in communications out of session state 330, crossing controller 240 may activate crossing signaling and traffic control equipment 250.

If crossing controller 240 receives a valid vital communication message that passes checks, crossing controller 240 may transition 332 to communications in session state 320 and reset the message timer. When crossing controller 240 is in communications in session state 320, crossing controller 240 may deactivate crossing signaling and traffic control equipment 250 unless directed to activate crossing signaling and traffic control equipment 250 by crossing activation device electronics 210. Crossing controller 240 may remain 324 in communications in session state 320 and reset the message timer each time crossing controller 240 receives a valid vital communication message that passes checks.

If crossing controller 240 fails to receive a valid vital communication message that passes checks before the expiration of the message timer, crossing controller 240 may transition 322 to communications out of session state 330 and activate crossing signaling and traffic control equipment 250.

Figure 4:
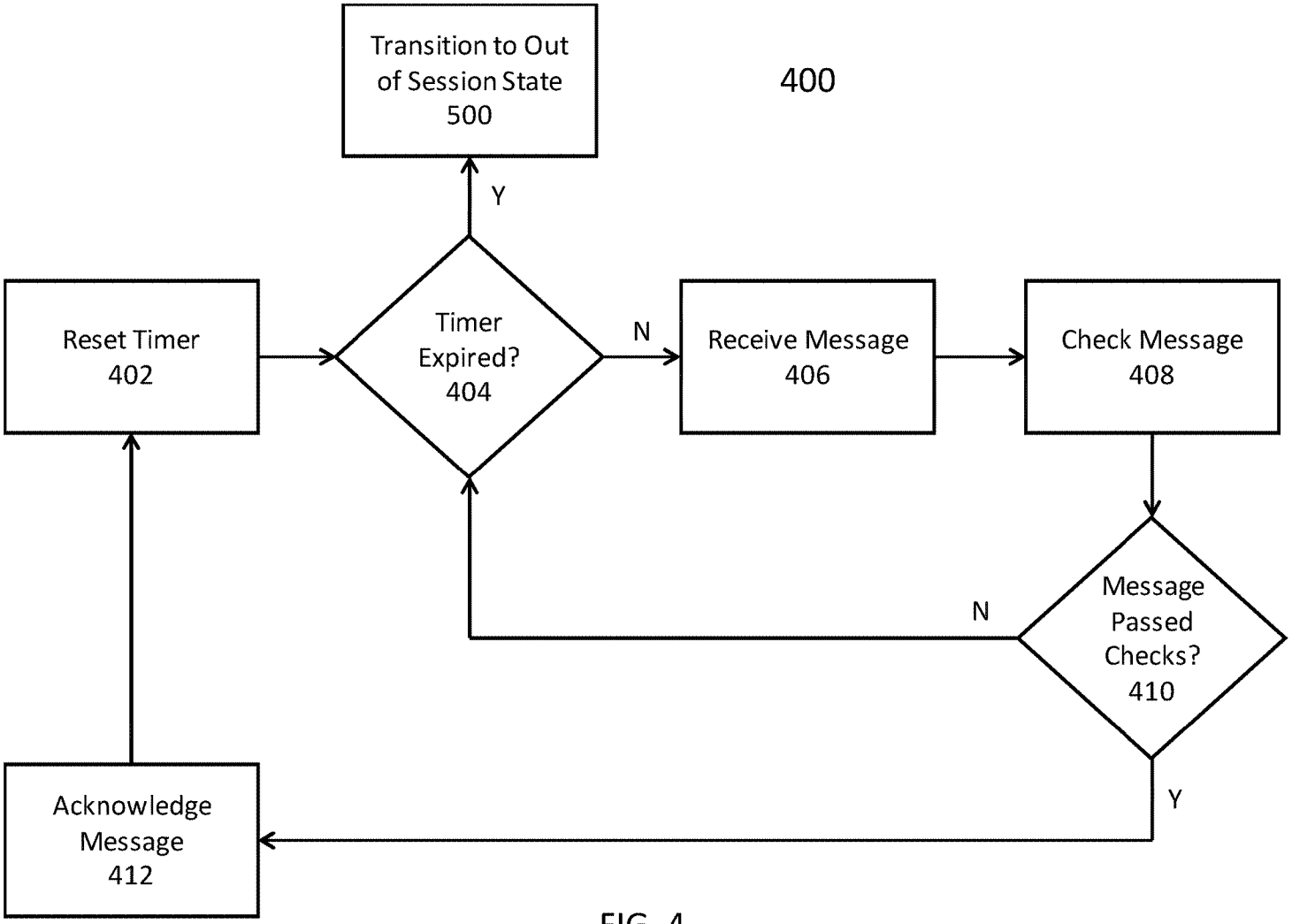
FIG. 4 is a flow diagram for communications in session processing according to an embodiment of the invention.
Figure 5:
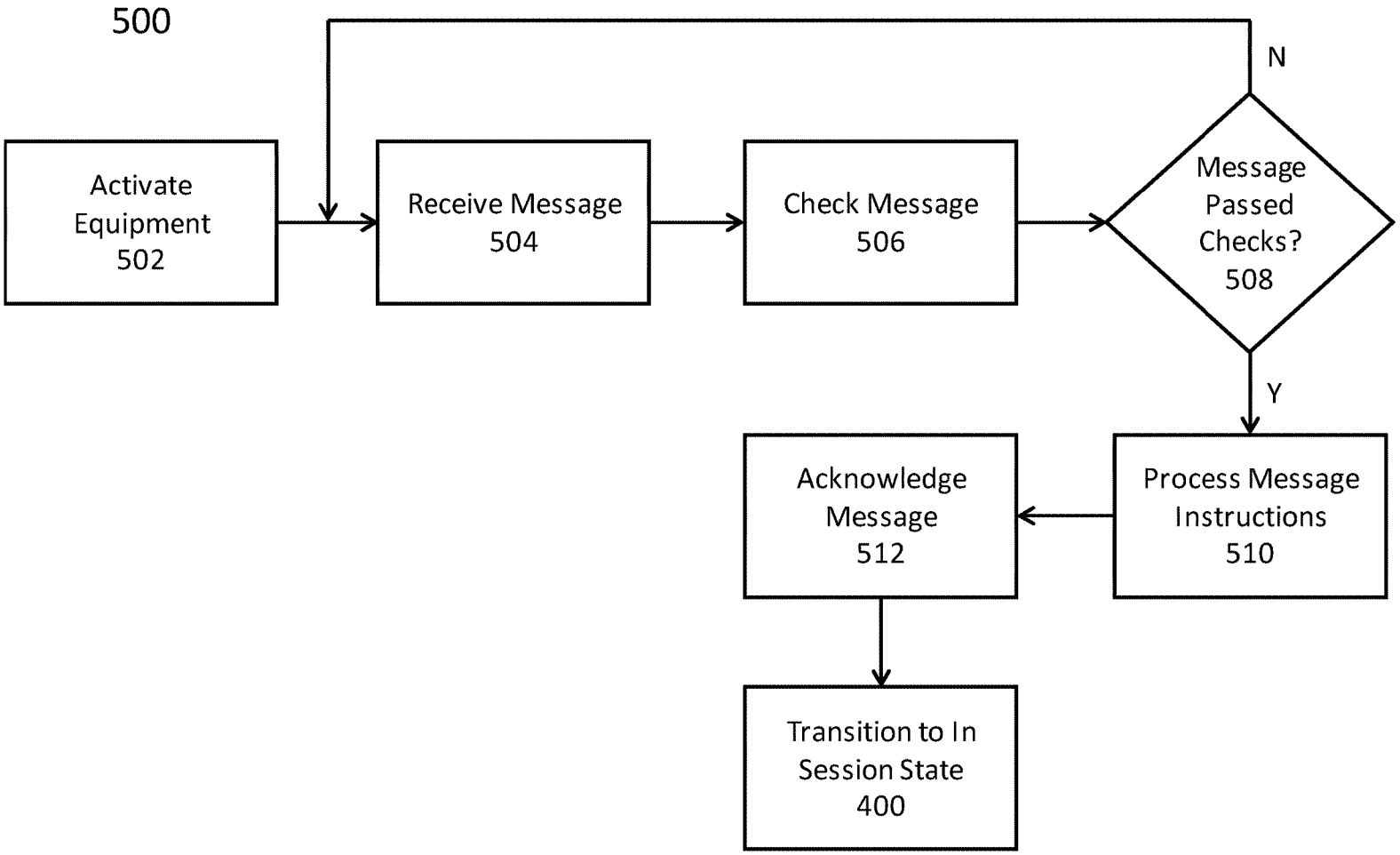
FIG. 5 is a flow diagram for communications out of session processing according to an embodiment of the invention.

As discussed above, the transitions between states may be dictated by whether crossing controller 240 receives a valid vital message before the expiration of a message timer. FIGS. 4 and 5 illustrate processes whereby crossing controller 240 may evaluate messages, control crossing signaling and traffic control equipment 250, and transition between states.

FIG. 4 is a flow diagram for communications in session processing 400 according to an embodiment of the invention. Crossing controller 240 may enter communications in session state 320 after receiving a valid vital communications message and begin process 400.

At 402, crossing controller 240 may reset the message timer. The message timer may define a period of time for which crossing controller 240 can remain in communications in session state 320 without receiving a vital communications message. The time period may correspond to an expected frequency of periodic vital communications message transmissions by crossing activation device vital communication system 220. For example, in some embodiments, the period of time may be 100 ms, because crossing activation device vital communication system 220 may be configured to transmit a vital communications message every 100 ms.

At 404, if the message timer expires before mast vital communication system 230 receives a message, crossing controller 240 may transition to communications out of session state 330. For example, failure to receive a message within the period of time defined by the message timer may indicate there is a problem with crossing activation device 140. As a precaution, crossing controller 240 may transition to communications out of session state 330 to prevent traffic from path 120 from encroaching on rail 110.

At 406, crossing controller 240 may receive a message prior to the expiration of the message timer. For example, mast vital communication system 230 may detect a message and send the message to crossing controller 240 for evaluation.

At 408, crossing controller 240 may check the message. For example, vital communications messages sent by crossing activation device vital communication system 220 may include a codeword or phrase or other data that may be inserted into every message (e.g., a cyclic redundancy check (CRC) codeword). Crossing controller 240 may check the message to verify that the codeword is present within the message and correct. This check may allow crossing controller 240 to confirm that the received message is a message from crossing activation device vital communication system 220 intended for crossing controller 240, as opposed to a message from another source, a message intended for another recipient, or a corrupted message.

In some embodiments, vital communications messages sent by crossing activation device vital communication system 220 may include a sequence number or word inserted into every message. For example, as it sends out vital communications messages in sequence, crossing activation device vital communication system 220 may insert sequence numbers into the messages, so the first message may be message 1, the next message may be message 2, etc. Crossing controller 240 may check the message to verify that the message is received in the correct sequence. This check may allow crossing controller 240 to confirm that the received message is truly the next message sent by crossing activation device vital communication system 220. For example, if there is a problem with crossing activation device 140 causing the same vital communications message to be sent repeatedly, crossing controller 240 may identify this problem by determining the sequence number is not advancing.

At 410, crossing controller 240 may determine whether the message has passed the checks. If not, crossing controller 240 may wait for the message timer to expire before transitioning to communications out of session state 330 and performing communications out of session processing 500 shown in FIG. 5 (e.g., in case the correct message is still en route). If the message passes the checks, crossing controller 240 may restart process 400 by resetting the message timer 402, thereby remaining in communications in session state 320 for another cycle.

At 412, mast vital communication system 230 may acknowledge the message. For example, in some embodiments, crossing controller 240 may generate an acknowledgement message including diagnostic information for some or all mast electronics 160. Example diagnostic information may include lamp filament integrity, gate position, bell sonic intensity, etc. Mast vital communication system 230 may transmit the message to crossing activation device vital communication system 220, and crossing activation device electronics 210 may process the message (e.g., store and/or analyze the diagnostic information and/or send the diagnostic information to other railway systems for storage and/or analysis).

FIG. 5 is a flow diagram for communications out of session processing 500 according to an embodiment of the invention. Crossing controller 240 may enter communications out of session state 330 upon power up or upon expiration of the message timer and begin process 500.

At 502, crossing controller 240 may activate crossing signaling and traffic control equipment 250. While in communications out of session state 330, crossing controller 240 may safeguard against approaching trains not being reported by crossing activation device 140 by defaulting to restricting access to rails 110 by traffic on path 120.

At 504, crossing controller 240 may receive a message. For example, mast vital communication system 230 may detect a message and send the message to crossing controller 240 for evaluation. Crossing controller 240 may be able to transition out of communications out of session state 330 if a valid vital communications message is received.

At 506, crossing controller 240 may check the message. For example, vital communications messages sent by crossing activation device vital communication system 220 may include a codeword or phrase or other data that may be inserted into every message (e.g., a CRC codeword). Crossing controller 240 may check the message to verify that the codeword is present within the message and correct. This check may allow crossing controller 240 to confirm that the received message is a message from crossing activation device vital communication system 220 intended for crossing controller 240, as opposed to a message from another source, a message intended for another recipient, or a corrupted message.

In some embodiments, vital communications messages sent by crossing activation device vital communication system 220 may include a sequence number or word inserted into every message. For example, as it sends out vital communications messages in sequence, crossing activation device vital communication system 220 may insert sequence numbers into the messages, so the first message may be message 1, the next message may be message 2, etc. Crossing controller 240 may check the message to verify that the message is received in the correct sequence. This check may allow crossing controller 240 to confirm that the received message is truly the next message sent by crossing activation device vital communication system 220. For example, if there is a problem with crossing activation device 140 causing the same vital communications message to be sent repeatedly, crossing controller 240 may identify this problem by determining the sequence number is not advancing.

At 508, crossing controller 240 may determine whether the message has passed the checks. If not, crossing controller 240 may remain in communications out of session state 330. For example, crossing controller 240 may keep crossing signaling and traffic control equipment 250 active and wait for another message to arrive.

At 510, if the message passes the checks, crossing controller 240 may process instructions in the message. For example, if the message indicates that no train is approaching, crossing controller 240 may deactivate crossing signaling and traffic control equipment 250.

At 512, mast vital communication system 230 may acknowledge the message. For example, in some embodiments, crossing controller 240 may generate an acknowledgement message including diagnostic information for some or all mast electronics 160. Example diagnostic information may include lamp filament integrity, gate position, bell sonic intensity, etc. Mast vital communication system 230 may transmit the message to crossing activation device vital communication system 220, and crossing activation device electronics 210 may process the message (e.g., store and/or analyze the diagnostic information and/or send the diagnostic information to other railway systems for storage and/or analysis).

After deactivating crossing signaling and traffic control equipment 250 and/or acknowledging the message, crossing controller 240 may transition to communications in session state 320 and perform communications in session processing 400 shown in FIG. 4.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. For example, other steps may be provided, or steps may be eliminated, from the described flows, and other components may be added to, or removed from, the described systems. Accordingly, other implementations are within the scope of the following claims.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A railroad crossing control system comprising:

a communication system configured to wirelessly communicate with a crossing activation device communication system;

at least one crossing traffic control element; and a crossing controller in communication with the communication system and the at least one crossing traffic control element, the crossing controller being configured to:

check a message received at the communication system to determine whether the message is a valid vital communication;

in response to determining the message is the valid vital communication, deactivate the at least one crossing traffic control element;

while the at least one crossing traffic control element is deactivated, activate the at least one crossing traffic control element in response to receiving a command to activate the at least one crossing traffic control element at the communication system; and in response to determining the message is not the valid vital communication, activate the at least one crossing traffic control element.

2. The system of claim 1, wherein the crossing controller is further configured to:

determine that a message timer has elapsed; and in response to determining that the message timer has elapsed, activate the at least one crossing traffic control element.

3. The system of claim 1, wherein the crossing controller is further configured to reset a message timer in response to determining the message is the valid vital communication.

4. The system of claim 1, wherein the crossing controller is configured to check the message received at the communication system to determine whether the message is the valid vital communication by a process comprising:

determining the message was sent by the crossing activation device communication system; and determining the message is uncoruppted.

5. The system of claim 1, wherein the crossing controller is configured to check the message received at the communication system to determine whether the message is the valid vital communication by a process comprising:

determining whether the message contains a predetermined code; and in response to determining the message does not contain the predetermined code, determining the message is not the valid vital communication.

6. The system of claim 5, wherein the process further comprises:

in response to determining the message contains the predetermined code, determining the message is the valid vital communication.

7. The system of claim 5, wherein the process further comprises:

determining whether the message contains an expected counter value; and in response to determining the message does not contain the expected counter value, determining the message is not the valid vital communication.

8. The system of claim 7, wherein the process further comprises:

in response to determining the message contains the predetermined code and the expected counter value, determining the message is the valid vital communication.

9. The system of claim 1, wherein the at least one crossing traffic control element comprises a visual alert device, an audible alert device, a traffic restriction device, or a combination thereof.

10. The system of claim 1, wherein the crossing controller is further configured to:

determine diagnostic information for the at least one crossing traffic control element; and respond, by the communication system, to the message with a response message including the diagnostic information.

11. The system of claim 1, wherein the communication system, the at least one traffic control element, and the crossing controller are coupled to a same power source.

12. The system of claim 1, further comprising:

the crossing activation device communication system configured to send the message to the communication system; and a crossing activation device in communication with the crossing activation device communication system, the crossing activation device being configured to:

generate the message; and generate the command, wherein the crossing activation device and the crossing activation device communication system are housed separately from the communication system, the at least one traffic control element, and the crossing controller.

13. The system of claim 12, wherein the crossing activation device and the crossing activation device communication system are coupled to a different power source from a power source to which the communication system, the at least one traffic control element, and the crossing controller are coupled.

14. A railroad crossing control method comprising:

wirelessly receiving, by a communication system, a message;

checking, by a crossing controller, the message to determine whether the message is a valid vital communication;

in response to determining the message is the valid vital communication, deactivating, by the crossing controller, at least one crossing traffic control element;

while the at least one crossing traffic control element is deactivated, activating, by the crossing controller, the at least one crossing traffic control element in response to receiving a command to activate the at least one crossing traffic control element at the communication system; and in response to determining the message is not the valid vital communication, activating, by the crossing controller, the at least one crossing traffic control element.

15. The method of claim 14, further comprising:

determining, by the crossing controller, that a message timer has elapsed; and in response to determining that the message timer has elapsed, activating, by the crossing controller, the at least one crossing traffic control element.

16. The method of claim 14, further comprising resetting, by the crossing controller, a message timer in response to determining the message is the valid vital communication.

17. The method of claim 14, wherein the checking comprises:

determining the message was sent by the crossing activation device communication system; and determining the message is uncoruppted.

18. The method of claim 14, wherein the checking comprises:

determining whether the message contains a predetermined code; and in response to determining the message does not contain the predetermined code, determining the message is not the valid vital communication.

19. The method of claim 18, wherein the checking further comprises:

in response to determining the message contains the predetermined code, determining the message is the valid vital communication.

20. The method of claim 18, wherein the checking further comprises:

determining whether the message contains an expected counter value; and in response to determining the message does not contain the expected counter value, determining the message is not the valid vital communication.

21. The method of claim 20, wherein the checking further comprises:

in response to determining the message contains the predetermined code and the expected counter value, determining the message is the valid vital communication.

22. The method of claim 14, further comprising:

determining, by the crossing controller, diagnostic information for the at least one crossing traffic control element; and responding, by the communication system, to the message with a response message including the diagnostic information.

* * * * *